US008995236B2

(12) United States Patent
Fujisawa

(10) Patent No.: US 8,995,236 B2
(45) Date of Patent: Mar. 31, 2015

(54) ELECTRONIC TIMEPIECE WITH INTERNAL ANTENNA

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 16 days.

(21) Appl. No.: 14/022,559

(22) Filed: Sep. 10, 2013

(65) Prior Publication Data

US 2014/0086020 A1 Mar. 27, 2014

(30) Foreign Application Priority Data

Sep. 24, 2012 (JP) ..... 2012-209025

(51) Int. Cl.
*G04R 60/12* (2013.01)
*G04R 60/10* (2013.01)
*G04R 20/04* (2013.01)

(52) U.S. Cl.
CPC ..... *G04R 60/10* (2013.01); *G04R 60/12* (2013.01); *G04R 20/04* (2013.01)
USPC ..... 368/47; 343/718

(58) Field of Classification Search
USPC ..... 368/47
See application file for complete search history.

(56) References Cited

U.S. PATENT DOCUMENTS

| | | | | |
|---|---|---|---|---|
| 6,724,690 | B1 * | 4/2004 | Endo et al. | 368/10 |
| 7,659,858 | B2 * | 2/2010 | Abe et al. | 343/718 |
| 7,724,199 | B2 * | 5/2010 | Someya et al. | 343/788 |
| 8,040,287 | B2 * | 10/2011 | Kimura | 343/787 |
| 2011/0013491 | A1 | 1/2011 | Fujisawa | |
| 2011/0051561 | A1 * | 3/2011 | Fujisawa | 368/47 |

FOREIGN PATENT DOCUMENTS

| | | | |
|---|---|---|---|
| JP | 4551678 | B2 | 9/2010 |
| JP | 2011-021929 | A | 2/2011 |
| JP | 2012-075090 | A | 4/2012 |
| JP | 2012-075091 | A | 4/2012 |

* cited by examiner

*Primary Examiner* — Amy Cohen Johnson
*Assistant Examiner* — Jason Collins
(74) *Attorney, Agent, or Firm* — Harness, Dickey & Pierce, P.L.C.

(57) ABSTRACT

An electronic timepiece has a case of which at least part is made from a conductive material; an annular antenna housed in the case; and a dial disposed inside the antenna. The antenna has an annular dielectric base. The base has a sloped surface that slopes toward the dial and decreases in height to the dial with proximity to the inside. The antenna element is made from a conductive material and is fed by the feed part of the antenna, and is disposed to the sloped surface of the base.

6 Claims, 13 Drawing Sheets

FIG. 5A
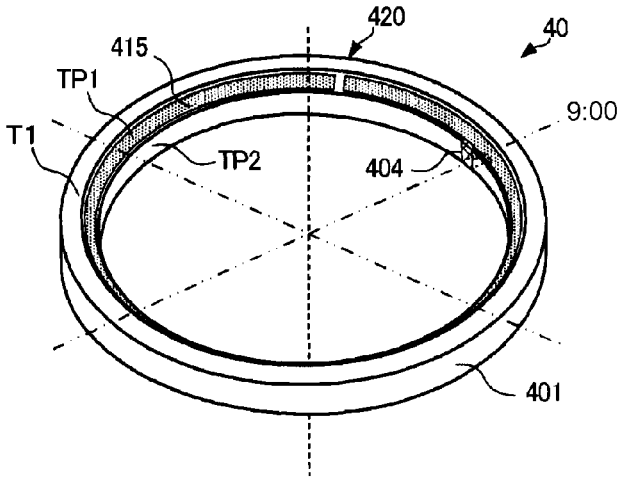
FIG. 5B
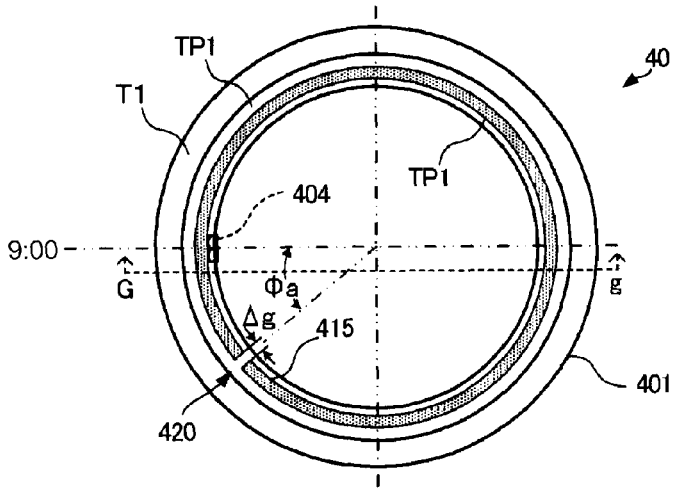
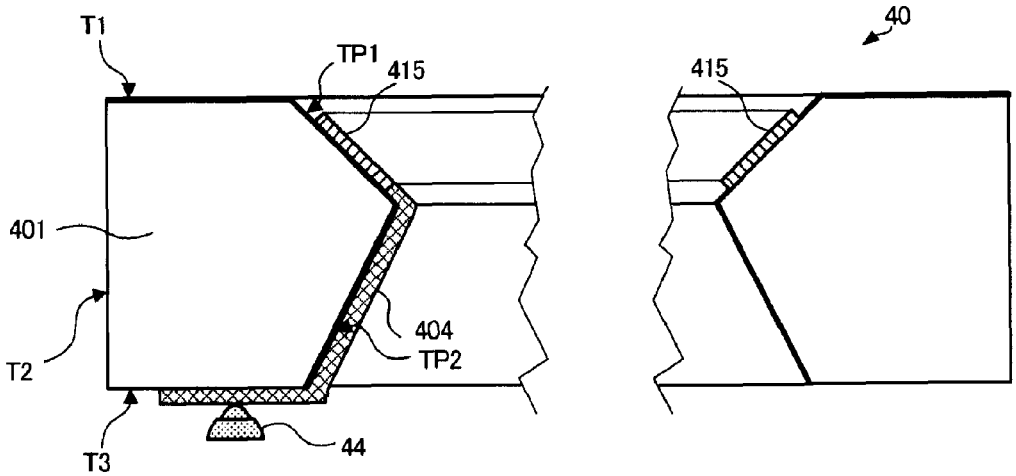
FIG. 5C

FIG.12A
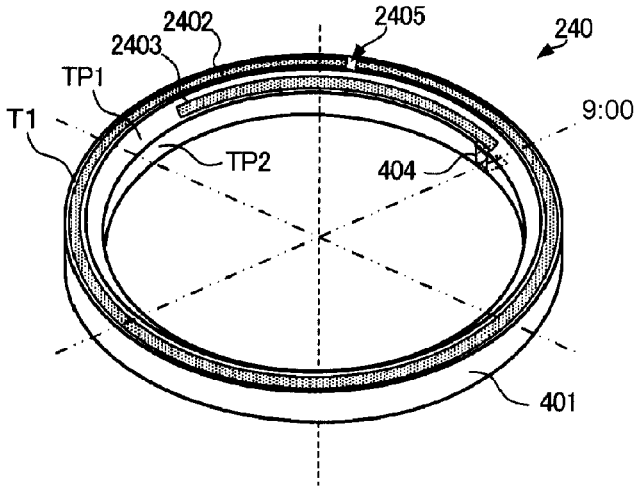
FIG.12B
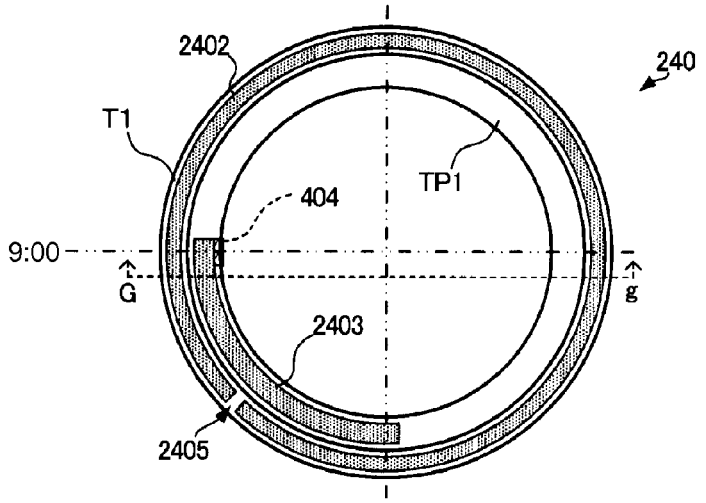
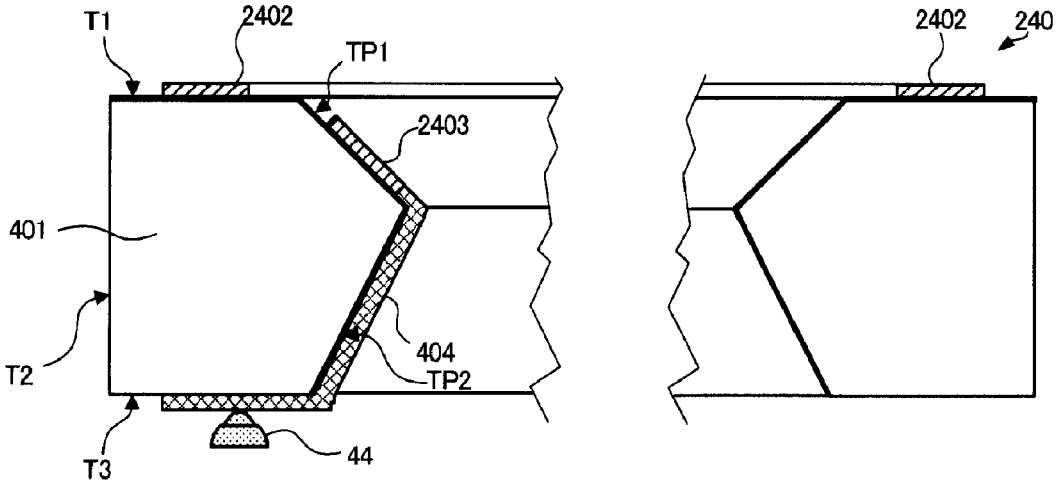
FIG.12C

ELECTRONIC TIMEPIECE WITH INTERNAL ANTENNA

BACKGROUND

1. Technical Field

The present invention relates to an electronic timepiece with an internal antenna.

2. Related Art

Electronic timepieces that receive signals from positioning information satellites such as GPS (Global Positioning System) satellites to display accurate time are known from the literature. Such electronic timepieces commonly have a ring-shaped antenna for receiving radio signals from the positioning information satellites. See, for example, Japanese Unexamined Patent Appl. Pub. JP-A-2011-21929, and Japan Patent No. 4551678.

The ring-shaped antenna is disposed around the time display part (such as the dial) of the electronic timepiece. The antenna includes an annular base made of a dielectric material (an electrical insulator), and an annular part made of a conductive material formed on the base.

If the ring-shaped antenna disposed around the time display is located too close to the time display, viewing the time display may be obstructed. However, disposing the antenna to a position far from the time display requires a large area outside of the time display, and the size of the electronic timepiece increases accordingly.

An electronic timepiece may also have a metal case on the exterior. If the ring-shaped antenna is near the metal case, antenna sensitivity drops. If the ring-shaped antenna is located far from the case, a large space is required between the outside of the time display and the inside of the case, and the size of the electronic timepiece increases accordingly.

SUMMARY

The present invention is directed to the foregoing problem, and achieves a time display that can be easily read and an antenna with good reception performance while suppressing increasing the size of an electronic timepiece that has an internal antenna.

One aspect of the invention is an electronic timepiece with internal antenna, including: a case of which at least part is made from a conductive material; an annular antenna housed in the case; a feed part that feeds the antenna housed in the case; and a time display unit disposed inside the antenna in plan view. The antenna has an annular dielectric base, and an antenna element that is made from a conductive material and is fed by the feed part. The base has a sloped surface that slopes toward the time display unit and decreases in height to the time display unit with proximity to the inside. The antenna element is disposed to the sloped surface of the base.

Because the base of the antenna has a sloped face and this face decreases in height to the time display unit with proximity to the inside, the time display unit (such a timepiece dial) can be seen from a wide angle of view. Furthermore, because a conductive antenna element through which the antenna is fed is disposed to this slope, the antenna element can be disposed to a position where radio waves from the outside cannot be easily blocked by the case, at least part of which is made from a conductive material. The acceptance angle of the antenna element is therefore wide, and good reception performance can be assured in the antenna.

Because using such a slope makes the time display unit easy to see and increases the acceptance angle of the antenna element, there is no need to create a wide area around the outside of the time display unit, and increasing the size of the electronic timepiece can be suppressed.

The antenna base in an electronic timepiece with an internal antenna according to another aspect of the invention preferably preferably has a top that is parallel to the time display unit; and the sloped surface is contiguous to the top in plan view.

Parallel as used here includes substantially parallel.

Further preferably, the electronic timepiece with internal antenna according to another aspect of the invention has a dial ring that is attached to the case, disposed outside the time display unit, made from a non-conductive material that covers the antenna, and the dial ring has a sloped part parallel to the sloped surface of the base of the antenna. Parallel as used here includes substantially parallel.

Because the dial ring is made of a non-conductive material, the dial ring does not interfere with signal reception by the antenna. Furthermore, because the dial ring covers the antenna, the antenna is hidden and does not detract from the appearance of the electronic timepiece. The time display unit can also be read from a wide angle of view because the dial ring has a slope parallel to the slope of the base, and this slope also decreases in height to the time display unit to the inside.

Note that "annular" as used herein means a continuous, uninterrupted ring, is not limited to circular rings, and includes uninterrupted squares and other polygons.

An electronic timepiece with internal antenna according to another aspect of the invention also has a back cover made from a conductive material. The case is a cylindrical body made of a conductive material; the back cover is electrically connected to the body of the case, and electrically connected to the ground of the antenna element of the antenna; and the back cover and case body function as a ground plane.

In the electronic timepiece according to this aspect of the invention, the ground potential is stabilized and good reception performance can therefore be assured in the antenna as a result of the case body and the back cover, which have a large volume and area, functioning as a ground plane.

In an electronic timepiece according to another aspect of the invention, the case has a cylindrical body made of a conductive material, and a bezel made of a non-conductive material to which a crystal that protects the time display unit is attached; and the bezel is fit to the inside of the case body.

Because the bezel that holds the crystal attached to the case is made of a non-conductive material, the bezel does not interfere with signal reception by the antenna. The bezel is fit to the inside of the body, and the bezel increases the distance between the conductive body and the antenna, and more particularly the conductive part of the antenna. The acceptance angle through which the antenna can receive signals is therefore increased, and good reception performance can be assured.

In an electronic timepiece according to another aspect of the invention, the antenna element of the antenna is disposed to a position at a greater height from the time display unit than the body of the case.

The body of the casein this aspect of the invention is made of a conductive material, but by disposing the body closer in height to the time display unit than the antenna element of the antenna, the body has substantially no effect on the directions from which radio waves can reach the antenna element. The acceptance angle through which the antenna element can receive signals is therefore increased, and good reception performance can be assured.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5A to FIG. 5C describe the shape of the antenna 40 in the electronic timepiece 100 and the antenna pattern of the antenna 40.

FIG. 12A is an oblique view of an antenna 240 according to a first variation of the preferred embodiment, FIG. 12B is a plan view of the antenna 240, and FIG. 12C is a section view of the antenna 240 through line G-g in FIG. 12B.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Figure 1:
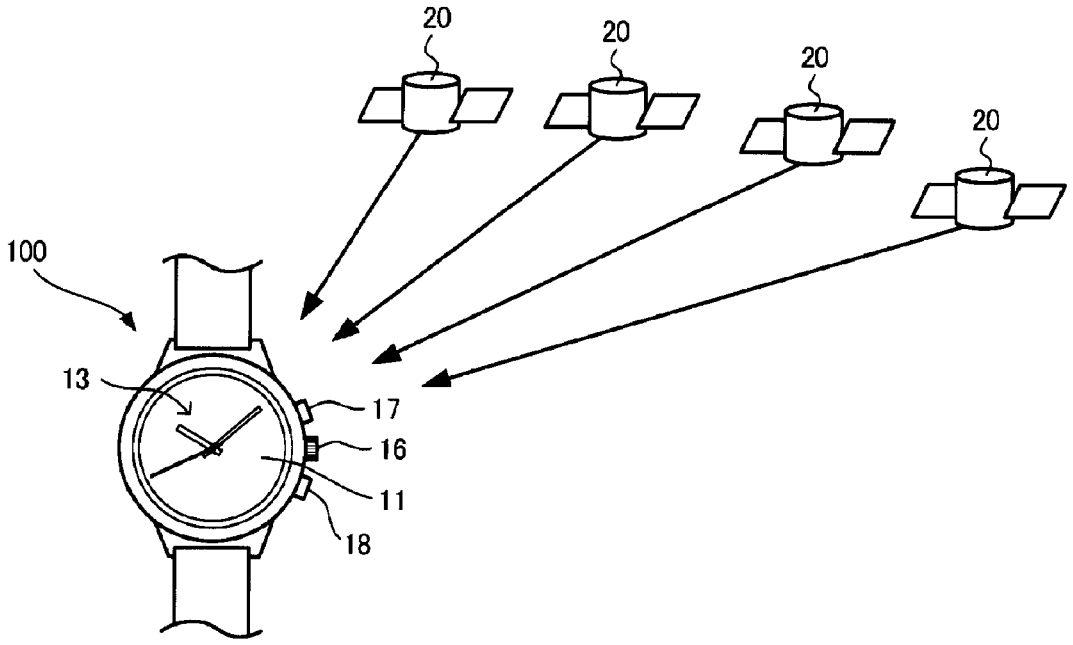
FIG. 1 is an overview of a GPS system including an electronic timepiece 100 with an internal antenna according to a first embodiment of the invention.

A. Mechanical Configuration of an Electronic Timepiece with Internal Antenna FIG. 1 shows the basic concept of a GPS system that includes an electronic timepiece 100 with an internal antenna according to a preferred embodiment of the invention.

The electronic timepiece 100 is a wristwatch that receives signals (radio signals) from at least one of plural GPS satellites 20 and adjusts the time based thereon, and displays the time on the surface (side) (referred to below as the "face") on the opposite side as the surface (referred to below as the "back") that contacts the wrist. The back side is also referred to below as the bottom, and the face side as the top.

A GPS satellite 20 is an example of a positioning information satellite that orbits the Earth on a specific orbit, and transmits a navigation message superimposed on a 1.57542 GHz RF signal (L1 signal). The 1.57542 GHz signal carrying a superimposed navigation message is referred to herein as simply a "satellite signal." These satellite signals are right-handed circularly polarized waves.

The invention is described below using the GPS system as an example of a satellite positioning system, but the invention is not so limited. More particularly, the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece 100 may therefore be a wristwatch that receives radio waves (radio signals) from positioning information satellites other than GPS satellites 20, and adjusts the internal time based thereon.

There are currently approximately 31 GPS satellites 20 in the constellation. Only 4 of the 31 satellites are shown in FIG. 1.

Each GPS satellite 20 superimposes a unique pattern called a C/A code (Coarse/Acquisition Code), which is a 1023-chip (1 ms) pseudorandom noise code unique to a specific GPS satellite 20, on the satellite signal. This code is used to identify which GPS satellite 20 transmitted a particular satellite signal. Each chip is a value of +1 or −1, and the C/A code appears to be a random pattern. The C/A code superimposed on the satellite signal can therefore be detected by correlating the satellite signal that is actually received with the known pattern of each C/A code.

Each GPS satellite 20 carries an atomic clock, and the highly precise time information ("GPS time information" below) kept by the atomic clock is included in the satellite signal transmitted by the GPS satellite 20. The time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and adjusts the internal time to the correct time using the GPS time information and time correction parameter contained in the received signal.

Orbit information indicating the position of the GPS satellite 20 on its orbit is contained in the satellite signal. The electronic timepiece 100 can calculate its own position using the GPS time information and orbit information. This position calculation assumes that there is some degree of error in the internal time kept by the electronic timepiece 100. More specifically, in addition to the three parameters for determining the three-dimensional position of the electronic timepiece 100, this time error is also an unknown. The electronic timepiece 100 therefore generally receives satellite signals from four or more GPS satellites, and calculates its own position using the GPS time information and orbit information contained in each of the received signals.

Figure 2:
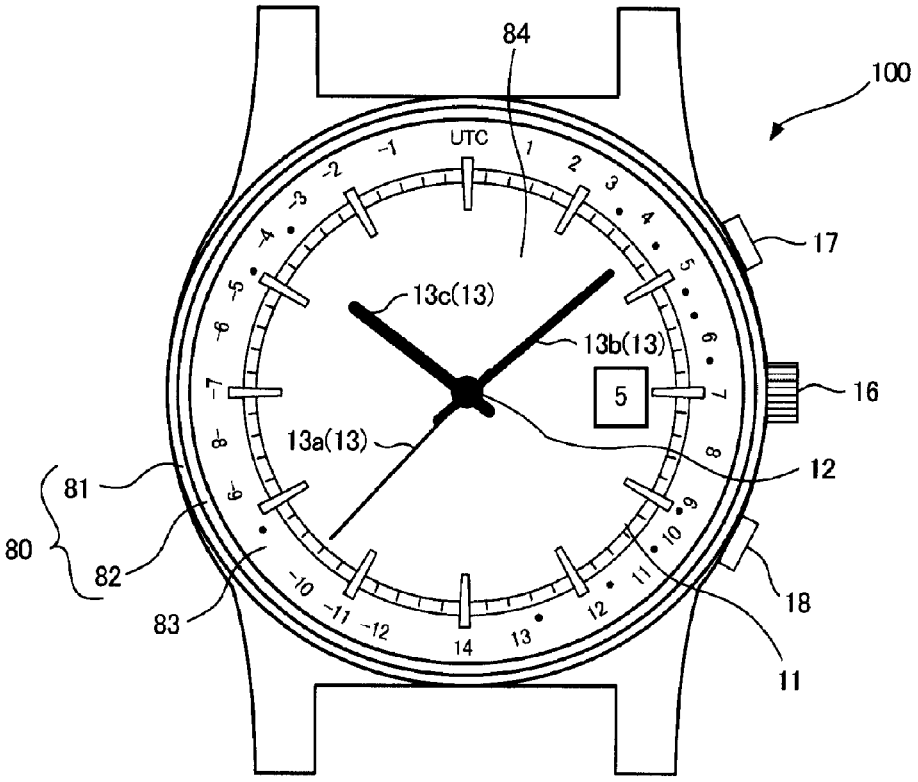
FIG. 2 is a plan view of the electronic timepiece 100.

FIG. 2 is a plan view of the electronic timepiece 100.

As shown in FIG. 2, the electronic timepiece 100 has an outside case 80. The case 80 includes a cylindrical body 81 made of metal or other conductive material, and a bezel 82 made of a non-conductive material such as ceramic. The bezel 82 is pressed into the body 81.

An annular dial ring 83 made of a non-conductive material such as plastic is disposed inside the bezel 82, and a round dial 11 is disposed inside the dial ring 83.

Bar-shaped hour markers are disposed every 30 degrees around the dial ring 83, and such markers are not disposed to the dial 11. The information shown on the dial ring 83 and the information shown on the dial 11 may be different from each other, and is not limited to the information shown in the figure.

Hands 13 (13*a* to 13*c*) that turn on a center pivot 12 and indicate the current time are disposed above the dial 11. The dial 11 may also be referred to as the time display unit below.

Further described below, the case 80 has two openings, one each on the face and the back cover sides.

The opening on the face side of the case 80 is covered by a crystal 84 through an intervening bezel 82, and the dial 11 and hands 13 (13*a* to 13*c*) are visible through the crystal 84.

As also shown in FIG. 1 and FIG. 2, the electronic timepiece 100 has a crown 16 and pushers 17, 18. The crown 16 and pushers 17, 18 can be manually operated to set the electronic timepiece 100 to at least a mode (time information acquisition mode) that receives satellite signals from at least one GPS satellite 20 and adjusts the internal time, and a mode (positioning information acquisition mode) that receives signals from plural GPS satellites 20, calculates the current position, and adjusts the time difference of the internal time. The electronic timepiece 100 can also execute the time information acquisition mode and positioning information acquisition mode regularly (automatically).

Figure 3:
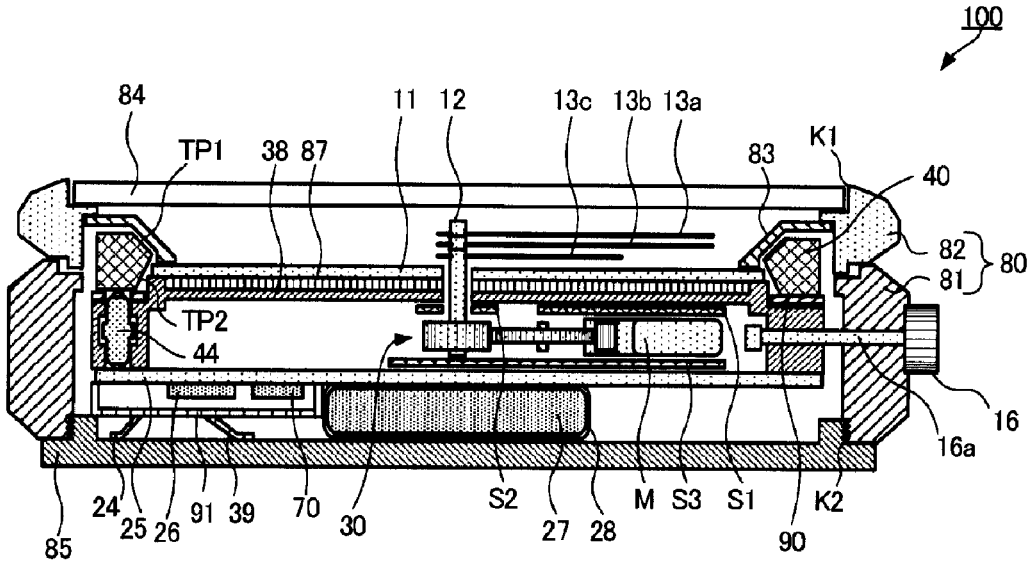
FIG. 3 is a partial section view of the electronic timepiece 100.
Figure 4:
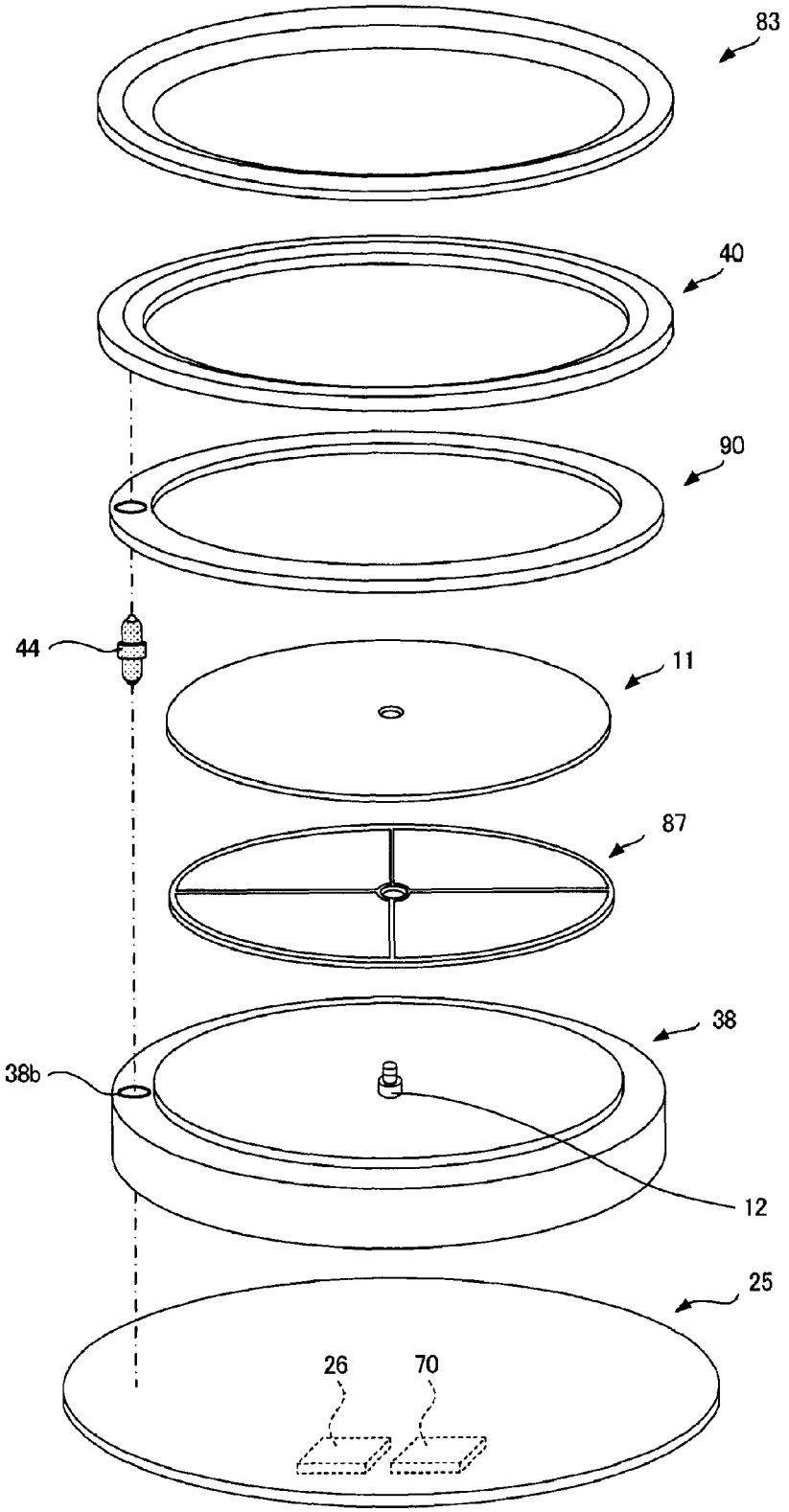
FIG. 4 is an exploded view of part of the electronic timepiece 100.

FIG. 3 is a section view showing the internal structure of the electronic timepiece 100, and FIG. 4 is an exploded oblique view showing parts of the electronic timepiece 100.

As shown in FIG. 3, the case 80 includes a cylindrical body 81 made of metal or other conductive material and a bezel 82 made of a non-conductive material such as ceramic, and the bezel 82 is pressed into the body 81. The case 80 has a top opening K1 and a bottom opening K2. The top opening K1 of the case 80 is covered by the round crystal 84, and the bottom opening K2 is covered by a back cover 85 made of SUS (stainless steel), Ti (titanium), or other conductive material. The body 81 and back cover 85 screw together, for example.

The ring-shaped dial ring 83 made of plastic or other non-conductive material is disposed to the inside circumference of the bezel 82 below (on the back cover side of) the crystal 84. The main plate 38 made of plastic or other non-conductive material is disposed inside the inside circumference of the body 81 below the dial ring 83.

A donut-shaped storage space is formed by the main plate 38, the dial ring 83, and inside surface of the case 80. The annular antenna 40 is housed in this space. The antenna 40 is therefore disposed on the inside side of the inside circumference of the bezel 82, and the top of the antenna 40 is covered by the dial ring 83.

An annular ground plane 90 made of metal is disposed in this space between the antenna 40 and the main plate 38. The ground plane 90 is electrically connected to the back cover 85 through a conductive spring 24, and is electrically connected to the body 81 because the back cover 85 is affixed to the body 81.

FIG. 5A to FIG. 5C describe the construction of the antenna 40.

FIG. 5A is an oblique view of the antenna 40, FIG. 5B is a plan view of the antenna 40, and FIG. 5C is a section view of the antenna 40 through line G-g in FIG. 5B.

The antenna 40 includes an annular base 401 made of a dielectric material, and an antenna element 415 formed on the base 401. The antenna element 415 is made of metal or other conductive material. A feed part 404 made of metal or other conductive material is also disposed to the antenna 40. The antenna element 415 and feed part 404 can be formed by a plating or silver paste printing process. The dielectric constant $\Sigma r$ of the base 401 material can be adjusted to approximately 5-20 by mixing a dielectric material that is used in high frequency applications, such as titanium oxide, with resin.

As shown in FIG. 5C, the base 401 has a pentagonal section including a top T1, outside face T2, bottom T3, slope TP1, and second slope TP2. The antenna element 415 is formed on slope TP1 as shown in the figure. The feed part 404 is formed on the slope TP1, second slope TP2, and bottom T3. The antenna element 415 is electrically connected to a feed pin 44 through the feed part 404, and a specific potential is thereby supplied to the antenna element 415 of the antenna 40.

As shown in FIG. 5B, the antenna element 415 has a notch 420, and thus forms a C-shape with a notch in the ring. The antenna element 415 has an antenna length that resonates to signals (satellite signals) from a positioning information satellite.

GPS satellites 20 transmit satellite signals at 1.575 GHz, the length of one wave is approximately 19 cm. Because an antenna length of approximately 1.0-1.2 wavelength is required to receive circularly polarized waves, a loop antenna of approximately 19-24 cm is required to receive a signal from a GPS satellite 20. Rendering a loop antenna with this antenna length in a wristwatch, however, results in a large wristwatch.

The base 401 of the antenna 40 in this embodiment is made from a material with a dielectric constant $\in r$ of approximately 5-20. When using a base 401 with a dielectric constant $\in r$, the wavelength shortening rate of the base 401 will be $(\Sigma r)^{-1/2}$. More specifically, the wavelength of the radio waves received by the antenna 40 can be shortened $(\Sigma r)^{-1/2}$ times by using a dielectric with a dielectric constant of $\Sigma r$. Because the antenna 40 according to this embodiment of the invention has a base 401 with a dielectric constant of $\in r$, the antenna length of the antenna 40 can be shortened $(\Sigma r)^{-1/2}$ times compared with a configuration not using the base 401, and the size of the antenna can be reduced.

As shown in plan view in FIG. 5B, the antenna element 415 is a C-shaped element, that is, a ring with notch removed, and functions as an antenna element that converts electromagnetic waves to current. The antenna element 415 is fed by the feed part 404. The impedance of the circuit electrically connected to the antenna 40 and the impedance of the antenna 40 can be matched by desirably setting the length of the antenna element 415.

The angle between the feed part 404 and the notch 420 is $\sqrt{a}$, the length of the notch 420 is $\Delta g$, the circumferential length of the antenna element 415 is C. If the wavelength of the received circularly polarized waves is $\lambda$ as described in Japan Patent No. 3982918, then preferably C=1.31⌊, $\Phi a$=40°, and $\Delta g$=0.018$\lambda$.

This embodiment uses a C-shaped antenna element 415 with a notch 420, but could alternatively use an O-shaped antenna element that is an endless loop.

FIG. 3 and FIG. 4 are referred to again below.

As shown in FIG. 3, an optically transparent dial 11, a center pivot 12 passing through the dial 11 and main plate 38, and hands 13 (second hand 13*a*, minute hand 13*b*, hour hand 13*c*) that move around the center pivot 12 and display the current time, are disposed inside the inside circumference of the antenna 40.

The center pivot 12 extends in the direction between the face and back along the center axis of the case 80. The dial 11 is round and made of plastic or other optically transparent non-conductive material. As shown in FIG. 3, the dial 11 is disposed between the crystal 84 and main plate 38. A hole through which the center pivot 12 passes is formed in the center of the dial 11. The hands 13 are disposed between the crystal 84 and the dial 11 inside the inside circumference of the antenna 40.

A drive mechanism (drive unit) 30 that causes the center pivot 12 to turn and drives the plural hands 13 is disposed below (on the back cover side of) the main plate 38. The drive mechanism 30 includes a stepper motor M and wheel train, and drives the hands 13 by the stepper motor M causing the center pivot 12 to turn through the wheel train. More specifically, the drive mechanism 30 causes the center pivot 12 to turn so that the hour hand 13*c* turns one revolution in 12 hours, the minute hand 13*b* turns one revolution in 60 minutes, and the second hand 13*a* turns one revolution in 60 seconds.

The electronic timepiece 100 has a circuit board 25 inside the case 80. The circuit board 25 is made of resin or other material including a dielectric, and is disposed below the drive mechanism 30 (that is, between the drive mechanism 30 and the back cover 85).

A circuit block including a GPS reception unit (radio receiver) 26 and control unit 70 is disposed on the bottom (on the surface facing the back of the wristwatch) of the circuit board 25. The GPS reception unit 26 is a single-chip IC module, for example, and includes analog and digital circuits. The control unit 70 sends control signals to the GPS reception unit 26 and controls the reception operation of the GPS reception unit 26, and controls operation of the drive mechanism 30.

A feed pin 44 made of metal or other conductive material is disposed above top side of the circuit board 25. The feed pin 44 has an internal spring, passes through a through-hole formed in the ground plane 90 and contacts the feed part 404 of the antenna 40, and passes through a through-hole 38*b* (FIG. 4) formed in the main plate 38 and contacts the circuit board 25. The feed part 404 of the antenna 40 is therefore electrically connected to the circuit board 25 (more precisely, to wiring disposed to the circuit board 25) through the feed pin 44, and a specific potential is supplied from the circuit board 25 to the antenna 40.

The circuit block including the GPS reception unit 26 and control unit 70 is covered by a shield 91 made of a conductive material. The shield 91 is electrically connected to the ground plane 90 through a circuit support 39, back cover 85, and body 81. The ground potential of the circuit block is supplied to the shield 91. More specifically, the shield 91, back cover 85, body 81, and ground plane 90 are held at the ground potential of the circuit block, and function as a ground plane.

The magnetic screens S1 and S2 are disposed between the drive mechanism 30 and main plate 38, and another magnetic screen S3 is disposed between the drive mechanism 30 and circuit board 25. Magnetic screens S1 and S2 are referred to below as a first magnetic screen, the magnetic screen S3 as a second magnetic screen, and magnetic screens S1 to S3 are made of a conductive material with high permeability, such as pure iron.

If there is a speaker or other object that produces a strong magnetic field on the outside of the electronic timepiece 100, the magnetic field can cause the stepper motor M to operate incorrectly. Of the parts of the electronic timepiece 100, metal in the body 81 and back cover 85 produces a magnetic field when magnetized. Circuit blocks on the circuit board 25 can also produce a magnetic field.

By covering the stepper motor M with magnetic screens S1 to S3 made of a material with high permeability, this embodiment of the invention magnetically shields the drive mechanism 30 and prevents the stepper motor M from operating incorrectly due to the magnetic fields described above.

A lithium ion battery or other cylindrically shaped storage battery 27, a battery compartment 28 for holding the storage battery 27, and a solar panel 87 that generates power by photovoltaic conversion, are also disposed inside the case 80 of the electronic timepiece 100.

The solar panel 87 is a round disc having plural solar cells (photovoltaic devices) that convert light energy to electrical energy (power) connected in series. The solar panel 87 is disposed inside the inside circumference of the antenna 40 and between the main plate 38 and dial 11, and a center hole through which the center pivot 12 passes is formed in the center of the solar panel 87.

The storage battery 27 is charged by the power produced by the solar panel 87. The battery compartment 28 for holding the storage battery 27 is below the circuit board 25 (that is, between the circuit board 25 and back cover 85).

The crown 16 and pushers 17, 18 (FIG. 2) are disposed to the outside of the case 80. Movement of the crown 16 resulting from the user of the electronic timepiece 100 operating the crown 16 is transferred through the stem 16*a* passing through the case 80 to the drive mechanism 30. Movement of the pusher 17 (or pusher 18) produced by the user of the electronic timepiece 100 pressing the pusher 17 (or pusher 18) is transferred to a switch not shown through the corresponding button stem 17*a* (or button stem 18*a*) (see FIG. 6) passing through the case 80. These switches convert pressure from the pusher 17 (or pusher 18) to an electrical signal, and output the signal to the control unit 70.

The crown 16, stem 16*a*, pushers 17, 18, and button stems 17*a* and 18*a* are also referred to below as operating units.

Figure 6:
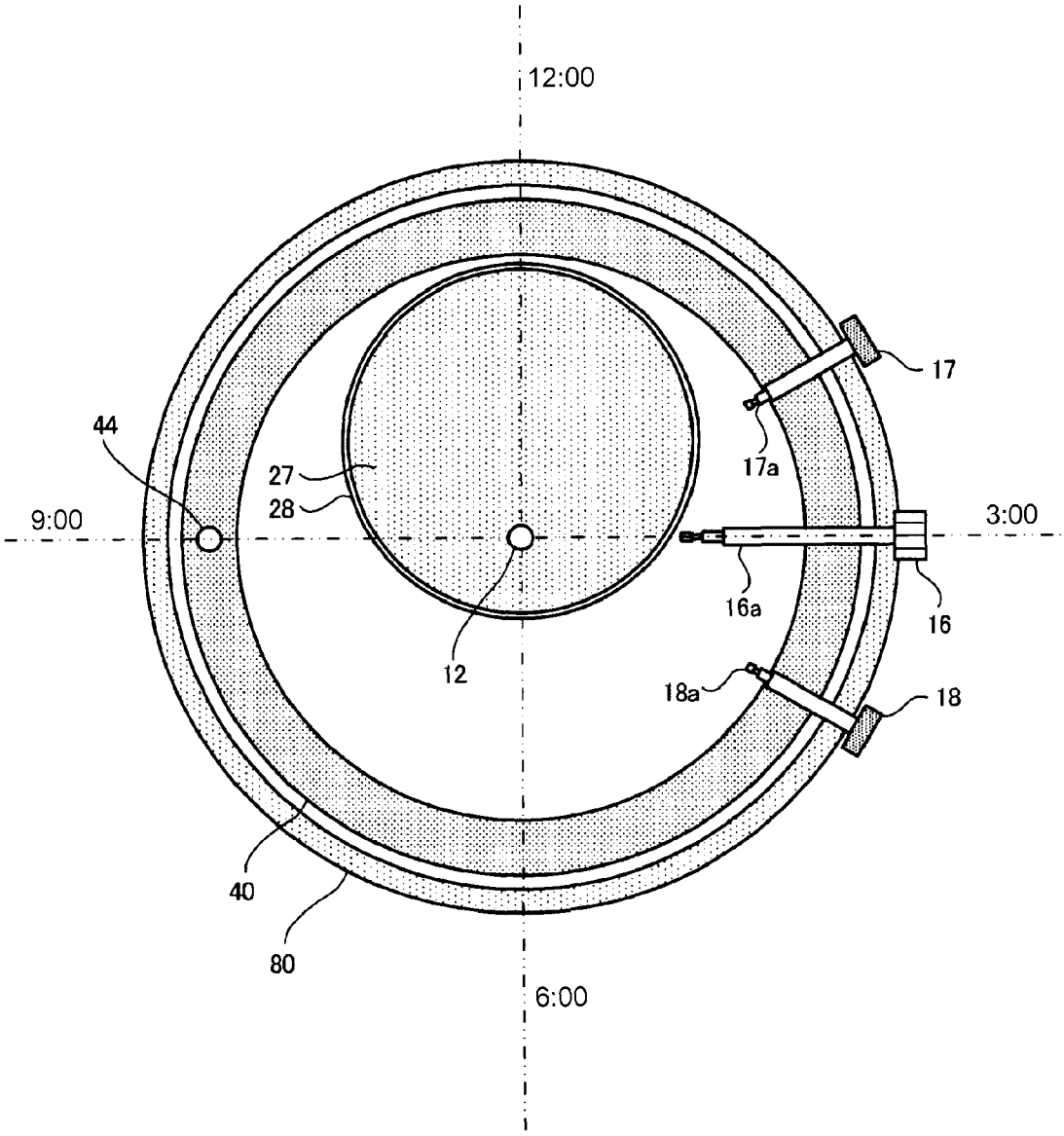
FIG. 6 describes the relative positions of the antenna 40, feed pin 44, and storage battery 27 in the electronic timepiece 100.

FIG. 6 shows the relative positions of the case 80, antenna 40, feed pin 44, storage battery 27 (battery compartment 28) and operating units (crown 16, stem 16*a*, pushers 17, 18, and button stems 17*a* and 18*a*) when seen in plan view (that is, when the electronic timepiece 100 is seen from the direction perpendicular to the dial 11).

As shown in FIG. 6, the battery compartment 28 is disposed so that the storage battery 27 (the storage battery 27 housed in the battery compartment 28) and the antenna 40 do not overlap when seen in plan view. The feed pin 44 is also disposed to a position not overlapping the storage battery 27 held in the battery compartment 28 when seen in plan view.

For structural reasons, the battery compartment 28 cannot be disposed to a position superimposed with the operating units (more specifically, the stem 16*a*) in plan view.

The feed pin 44 also cannot be disposed to a position superimposed with the operating units (more specifically, the stem 16*a* and button stems 17*a*, 18*a*) in plan view.

As a result, the battery compartment 28 and feed pin 44 are disposed where they are not superimposed with the operating units in plan view. For structural reasons, the battery compartment 28 is also disposed where it is not superimposed with the circuit block including the GPS reception unit 26 and control unit 70 (not shown in FIG. 6).

The location of the feed pin 44 is also limited by the relationship to the magnetic screens S1 to S3 described below.

The location of the feed pin 44 is therefore determined with consideration for its position relative to the magnetic screens S1 to S3 described below, and the relative position of the storage battery 27 to the operating units.

Figure 7:
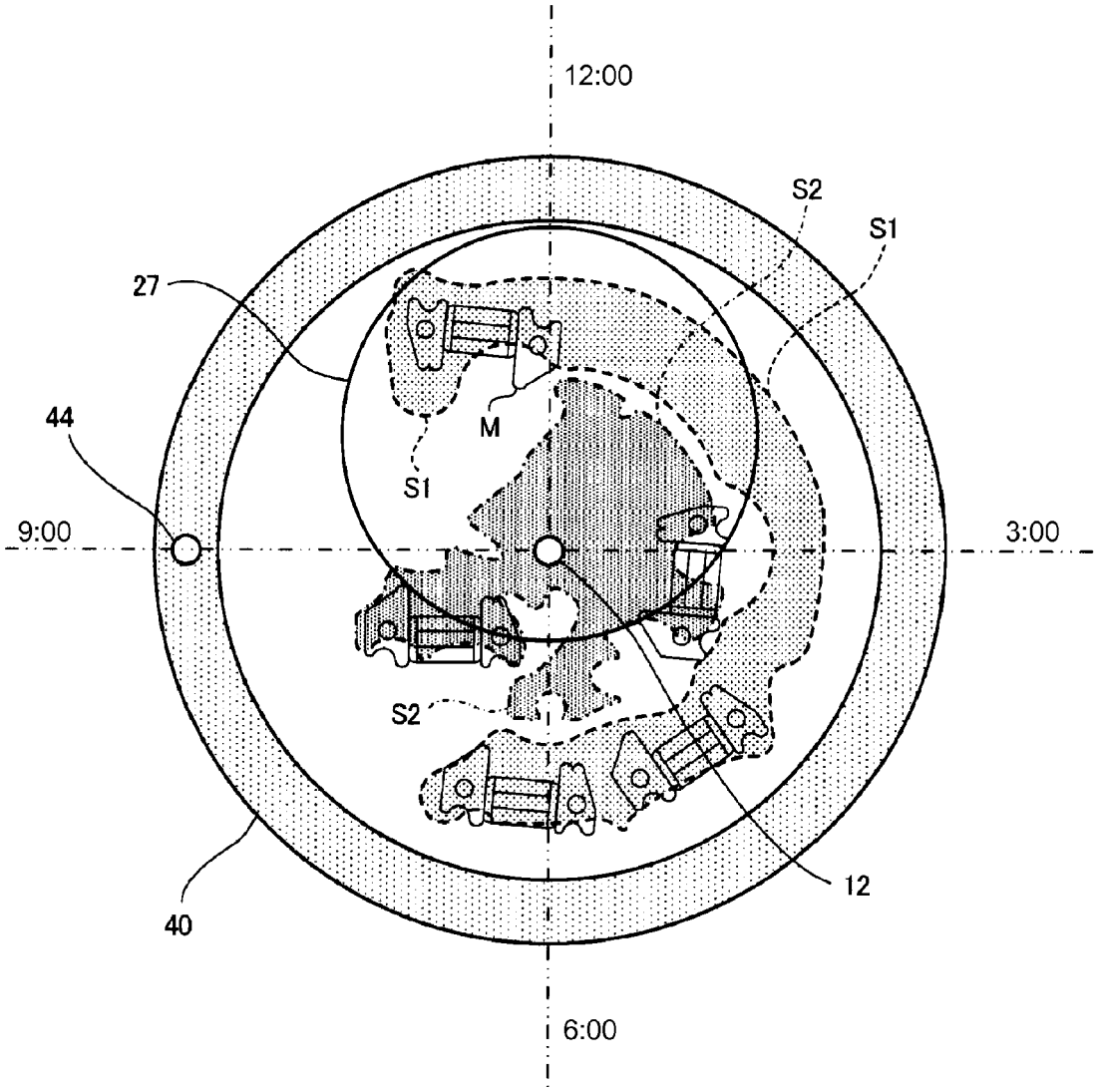
FIG. 7 describes the relative positions of the antenna 40, feed pin 44, storage battery 27, and magnetic screens S1 and S2 in the electronic timepiece 100.
Figure 8:
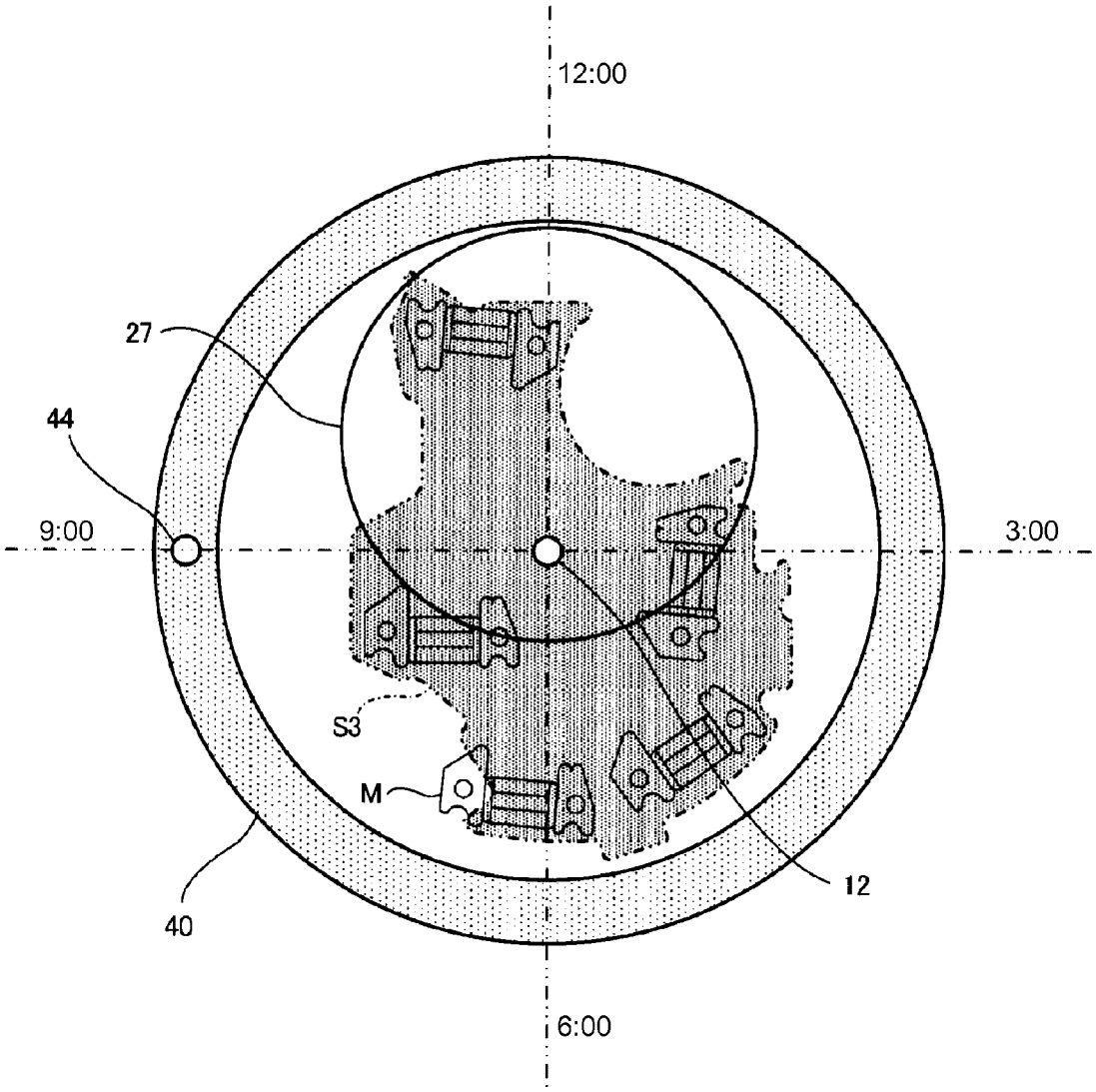
FIG. 8 describes the relative positions of the antenna 40, feed pin 44, storage battery 27, and magnetic screen S3 in the electronic timepiece 100.

FIG. 7 shows the relative positions of the antenna 40, feed pin 44, storage battery 27, magnetic screens S1 and S2, and stepper motor M in plan view. FIG. 8 shows the relative positions of the antenna 40, feed pin 44, storage battery 27, magnetic screen S3, and stepper motor M in plan view.

As shown in FIG. 7, the magnetic screens S1 and S2 are disposed superimposed with at least part of each stepper motor M. As shown in FIG. 8, magnetic screen S3 is disposed superimposed with at least part of each stepper motor M. Asa result, each stepper motor M is magnetically shielded from the magnetic fields produced from the outside of the drive mechanism 30, and incorrect operation of the stepper motors M due to these magnetic fields can be prevented.

B. Circuit Configuration of the Electronic Timepiece with Internal Antenna

Figure 9:
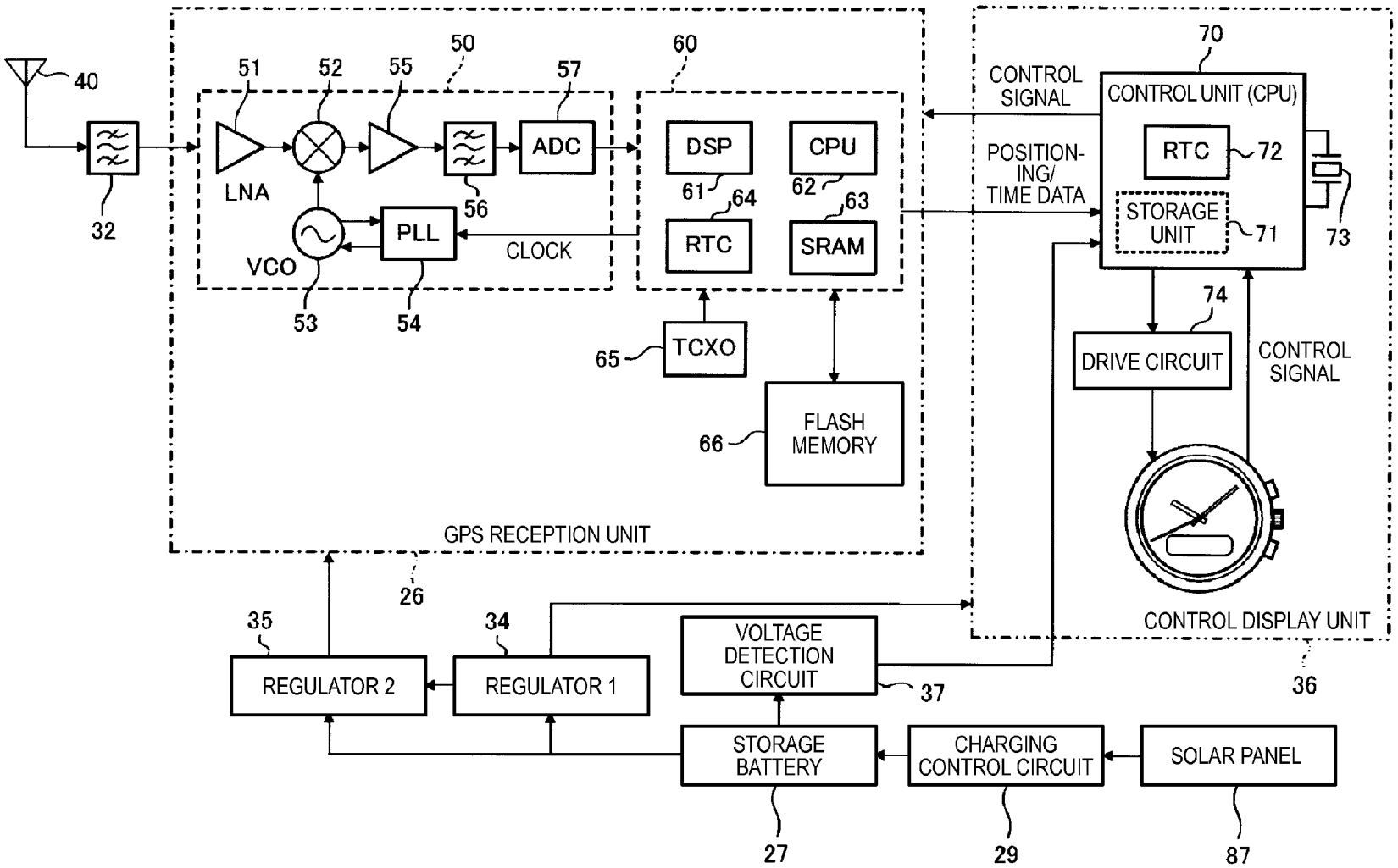
FIG. 9 is a block diagram showing the circuit configuration of the electronic timepiece 100.

FIG. 9 is a block diagram showing the circuit configuration of the electronic timepiece 100.

As shown in FIG. 9, the electronic timepiece 100 includes a GPS reception unit 26 and a control display unit 36. The GPS reception unit 26 executes processes related to receiving satellite signals, locking onto GPS satellites 20, generating positioning information, and generating time correction information, for example. The control display unit 36 executes processes including keeping the internal time and adjusting the internal time.

A solar panel 87 charges the storage battery 27 through the charging control circuit 29.

The electronic timepiece 100 has regulators 34 and 35, and the storage battery 27 supplies drive power through a regulator 34 to the control display unit 36, and supplies drive power through another regulator 35 to the GPS reception unit 26.

The electronic timepiece 100 also has a voltage detection circuit 37 that detects the voltage of the storage battery 27.

Regulator 35 could be split into a regulator 35-1 (not shown) that supplies drive power to the RF unit 50 (described below), and a regulator 35-2 (not shown) that supplies drive power to a baseband unit 60 (described below). In this implementation, regulator 35-1 could be disposed in the RF unit 50.

The electronic timepiece 100 also has the antenna 40 described above and a SAW (surface acoustic wave) filter 32. As described with reference to FIG. 1, the antenna 40 receives satellite signals from plural GPS satellites 20. However, because the antenna 40 also receives noise in addition to the satellite signals, the SAW filter 32 extracts the satellite signals from the signals received by the antenna 40. In other words, the SAW filter 32 functions as a bandpass filter that passes signals in the 1.5 GHz waveband.

The GPS reception unit 26 includes the RF (radio frequency) unit 50 and baseband unit 60. As described below, the GPS reception unit 26 executes a process that extracts satellite information including GPS time information and orbit information contained in the navigation message from the 1.5 GHz satellite signal extracted by the SAW filter 32.

The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

The satellite signal passed by the SAW filter 32 is amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the output clock signal of the VCO 53 to the reference clock signal. As a result, the VCO 53 can output a stable clock signal with the frequency precision of the reference clock signal. Note that several megahertz, for example, can be selected as the intermediate frequency.

The signal from the mixer 52 is amplified by the IF amplifier 55. However, mixing by the mixer 52 also produces a high frequency component of several GHz in addition to the IF signal. The IF amplifier 55 therefore amplifies both the IF signal and the high frequency component of several GHz. The IF filter 56 therefore passes the IF signal and removes the high frequency component of several GHz (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The temperature compensated crystal oscillator (TCXO) 65 generates a reference clock signal of a substantially constant frequency regardless of temperature. Time zone information, for example, is stored in flash memory 66. The time zone information defines the time difference between the current location and UTC based on specific coordinates (such as latitude and longitude).

The baseband unit 60 executes a process that demodulates the baseband signal from the digital signal (IF signal) output from the A/D converter 57 of the RF unit 50 when set to the time information acquisition mode or the positioning information acquisition mode.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, confirms synchronization with the GPS satellite 20 matching the local code (that is, confirms locking onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the satellite information from the satellite signal of the GPS satellite 20 that was locked onto in the time information acquisition mode or the positioning information acquisition mode, the baseband unit 60 executes a process that mixes the baseband signal with the local code of the same pattern as the C/A code of the GPS satellite 20 that was locked.

The navigation message containing the satellite information of the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired. The baseband unit 60 then generates the time adjustment information required to correct the internal time based on the satellite information.

In the time information acquisition mode, the baseband unit 60 more specifically calculates the time based on the GPS time information, and generates time correction information. The time correction information in the time information acquisition mode may be the GPS time information, or information about the time difference between the GPS time and internal time.

However, in the positioning information acquisition mode, the baseband unit 60 more specifically calculates the position based on the GPS time information and orbit information, and acquires the location information (more specifically calculates the latitude and longitude of the electronic timepiece 100 when the satellite signals were received). Next, the baseband unit 60 references the time difference (time zone) information stored in flash memory 66, and acquires the time difference at the coordinates (such as latitude and longitude) of the electronic timepiece 100 determined from the positioning information. The baseband unit 60 thus generates satellite time data (GPS time information) and time zone (time difference) data as the time correction information. The time correction information used in the positioning information acquisition mode may thus be the GPS time information and time zone information as described above, but the time difference between the internal time and the GPS time could be used instead of the GPS time information.

Note that the baseband unit 60 can generate the time correction information using the GPS time information from one GPS satellite 20, or the baseband unit 60 can generate the time correction information from satellite information from a plurality of GPS satellites 20.

Operation of the baseband unit 60 is synchronized to the reference clock signal output by the TCXO 65. The RTC 64 generates the timing for satellite signal processing, and counts up at the reference clock signal output from the TCXO 65.

The control display unit 36 includes a control unit 70, crystal oscillator 73, and drive circuit 74.

The control unit 70 includes a storage unit 71 and a RTC (real-time clock) 72, and controls various operations. The control unit 70 can be rendered with a CPU, for example. The control unit 70 outputs control signals to the GPS reception unit 26, and controls reception by the GPS reception unit 26. The control unit 70 also controls operation of regulators 34, 35 based on output from the voltage detection circuit 37. The control unit 70 also controls movement of the hands 13 through the drive circuit 74.

Reception data is stored in the storage unit 71. The control unit 70 adjusts the internal time based on the received data. The internal time is the time kept in the electronic timepiece 100 by the RTC 72. The RTC 72 operates continuously, and counts up at the reference clock signal generated by the crystal oscillator 73. The control unit 70 can therefore update the internal time and continue moving the hands even when power is not supplied to the GPS reception unit 26.

When the time information acquisition mode is set, the control unit 70 controls operation of the GPS reception unit 26, corrects the internal time based on the GPS time, and stores the time in the storage unit 71. More specifically, the internal time is corrected to UTC (Coordinated Universal Time) by adding a UTC offset to the acquired GPS time.

When the positioning information acquisition mode is set, the control unit 70 controls operation of the GPS reception unit 26, corrects the internal time based on the satellite time data (GPS time) and time zone (time difference) data, and stores the time in the storage unit 71.

C. Benefit of the Embodiment

As shown in FIG. 3 and FIG. 5, the electronic timepiece 100 according to this embodiment of the invention has a case 80 with a body 81 made from a dielectric material, an annular antenna 40 contained inside the case 80, a feed part 404 that feeds the antenna 40 in the case 80, and a dial 11 that is disposed inside of the antenna 40 and displays the time. The antenna 40 has an annular base made from a dielectric, and this base 401 has a top T1 parallel to the dial 11, and a slope TP1 that is continuous to the top T1 and is inclined to the dial 11 so that the height from the dial 11 decreases to the inside (that is, with proximity to the center pivot 12). The antenna 40 has an antenna element 415 that is made of a conductive material and is fed by the feed part 404, and the antenna element 415 is disposed to the slope TP1 of the base 401.

Because the base 401 of the antenna 40 has a slope TP1, and the height of the slope TP1 to the dial 11 decreases as the slope TP1 descends to the inside, the entire dial 11 can be read from a wide angle of view.

Furthermore, because the antenna element 415 of the antenna 40 that is fed is disposed to this slope TP1, the antenna element 415 can be located to a position where external radio waves are not easily blocked by the conductive body 81 of the case 80. The acceptance angle through which the antenna 40 can receive signals is therefore increased, and good reception performance can be assured. Furthermore, because providing such a slope TP1 makes the dial 11 easy to read and increases the acceptance angle of the antenna 40, a wide space does not need to be provided around the outside of the dial 11, and increasing the size of the electronic timepiece 100 can be suppressed.

Providing this slope TP1 also makes the electronic timepiece 100 appear thinner, and improves its appearance. This effect is not limited to when the information display part is a dial 11, and can also be achieved when a digital information display is disposed inside the antenna.

Figure 10:
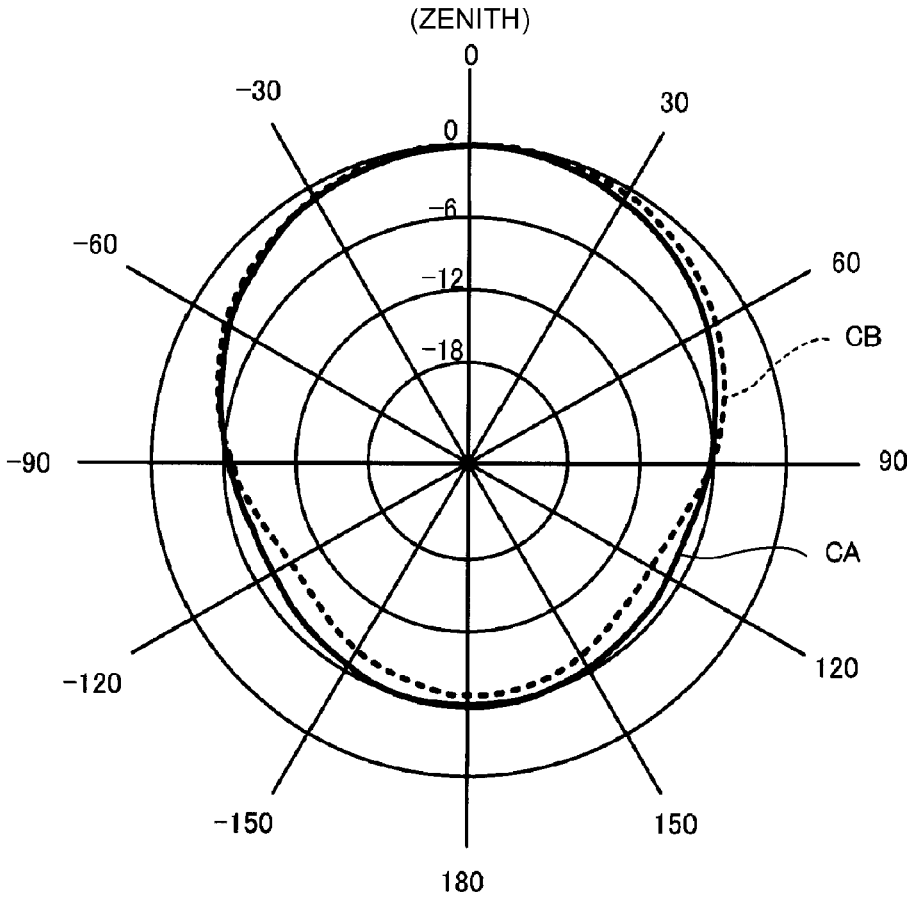
FIG. 10 shows the results of tests checking the advantage of the reception performance of the antenna in the electronic timepiece 100.

FIG. 10 is a graph showing the results of tests confirming the benefit of the reception performance of the antenna in the electronic timepiece 100 according to this embodiment of the invention. In FIG. 10 solid curve CA denotes the directivity of the antenna 40 in the electronic timepiece 100 according to this embodiment of the invention. Dotted curve CB denotes the directivity of the antenna 140 in an electronic timepiece with an antenna 140 used for comparison.

Figure 11:
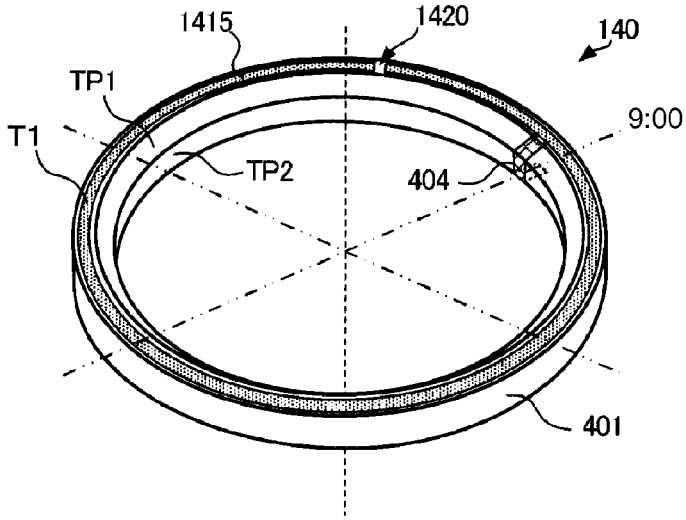
FIG. 11 is an oblique view of a different antenna 140 used in an electronic timepiece for comparison.

As shown in FIG. 11, the comparison antenna 140 has a C-shaped loop antenna element 1415 with a notch 1420 disposed to the top of a base 401 that is the same as the base 401 in this embodiment of the invention. This antenna element 1415 is fed by a feed part 404. Other aspects of this configuration are identical to this embodiment of the invention.

In FIG. 10 the gain of the antennas 40, 140 is normalized so that the peak gain of the antenna 40 according to the invention denoted by curve CA is 0 dB. Compared with the comparison antenna 140, the gain of the antenna 40 according to the invention is substantially equal in the direction of the zenith, average gain in all directions is good at 0.1 dB, the acceptance angle of the antenna 40 is greater, and the antenna 40 is practical for use in a wristwatch that could be oriented in many different directions when the user is walking, for example.

Only the body 81 of the case 80 is made from a conductive material in this embodiment, and the bezel 82 is made from a non-conductive material. However, the bezel 82 could be made from a conductive material.

When the bezel 82 is made from a conductive material, the reception performance of the antenna is degraded by the proximity of conductive material to the antenna element 415. However, by disposing the antenna element 415 to the slope TP1 of the base 401, the acceptance angle of the antenna 40 is increased, and some distance can be assured between the antenna element 415 and the bezel 82 by disposing the antenna element 415 to the inside slope TP1 instead of the top T1 of the base 401. As described above, however, a bezel 82 made of a non-conductive material is preferable.

As shown in FIG. 3 and FIG. 4, the electronic timepiece 100 has a dial ring 83 that is attached to the case 80, disposed outside the dial 11, and made of a non-conductive material covering the antenna 40, and the dial ring 83 has a sloped part parallel to the slope TP1 of the base 401 of the antenna 40. Because this dial ring 83 is non-conductive, it does not interfere with the antenna 40 receiving signals. Furthermore, because the dial ring 83 covers the antenna 40, the antenna 40 is hidden and does not detract from the appearance of the electronic timepiece 100. The dial 11 can also be read from a wide angle range because the dial ring 83 has a slope parallel to the slope TP1 of the base 401, and this slope also decreases in height to the dial 11 to the inside.

The case 80 in this embodiment has a cylindrical body 81 made of a conductive material, a bezel 82 made of a non-conductive material to which the crystal 84 that protects the dial 11 is attached, and the bezel 82 is fit to the inside of the body 81. Because the bezel 82 that holds the crystal 84 attached to the case 80 is made of a non-conductive material, the bezel 82 does not interfere with signal reception by the antenna 40. The bezel 82 is fit to the inside of the body 81, and the bezel 82 increases the distance between the antenna 40, and more particularly the antenna element 415, and the conductive body 81. The acceptance angle through which the antenna 40 can receive signals is therefore increased, and good reception performance can be assured. The results of tests confirming the benefit of the reception performance of the antenna are described below with reference to a first variation of the preferred embodiment.

The fed antenna element 415 of the antenna 40 is disposed to a position that is higher above the dial 11 than the body 81 of the case 80. The body 81 of the case 80 is made from a conductive material, but by disposing the body 81 at a position closer in height to the dial 11 than the antenna element 415 of the antenna 40, the body 81 has substantially no effect on the directions from which radio waves can be received by the antenna element 415. The acceptance angle through which the antenna element 415 can receive signals is therefore increased, and good reception performance can be assured.

The electronic timepiece 100 also has a back cover 85 made of a conductive material, the back cover 85 is electrically connected to the body 81 of the case 80, electrically connected to the ground of the antenna element 415 of the antenna 40, and the back cover 85 andbody 81 function as a groundplane. The groundpotential is stabilized, and good reception performance can therefore be assured in the antenna, as a result of the body 81 of the case 80 and the back cover 85, which have a large volume and area, functioning as a ground plane in the electronic timepiece 100.

Other Embodiments

The invention is not limited to the foregoing embodiment, and can be varied in many ways such as described in the following variations. One or more of the variations described below can also be desirably combined.

Variation 1

A first variation of the preferred embodiment is described with reference to FIG. 12. FIG. 12A is an oblique view of an antenna 240 according to a first variation of the preferred embodiment, FIG. 12B is a plan view of the antenna 240, and FIG. 12C is a section view of the antenna 240 through line G-g in FIG. 12B.

This antenna 240 has an annular dielectric base 401 as described in the foregoing embodiment, and antenna elements 2402 and 2403 formed on the base 401. These antenna elements 2402 and 2403 are made of metal or other conductive material.

A feed part 404 made of metal or other conductive material as in the foregoing embodiment is also disposed to the antenna 240. The antenna elements 2402 and 2403 and feed part 404 can be formed by a plating or silver paste printing process.

Antenna element 2402 is formed on the top T1 of the base 401, and antenna element 2403 is formed on the slope TP1. The feed part 404 is formed on the slope TP1, second slope TP2, and bottom T3 of the base 401. The other antenna element 2403 is electrically connected through the feed part 404 to the feed pin 44, and a specific potential is thereby supplied to the antenna element 2403 of the antenna 240. The antenna element 2402 is not fed by the feed part 404.

As shown in FIG. 12B, the antenna element 2402 has a notch 2405, and is a C-shaped loop element, that is, a loop with a portion of the ring removed. The antenna element 2402 has an antenna length that resonates to signals (satellite signals) from a positioning information satellite.

As shown in FIG. 12B, the antenna element 2403 is an arc-shaped element when seen in plan view, and is formed with a specific gap to antenna element 2402. These two antenna elements 2402 and 2403 are electromagnetically coupled, and function as an antenna element that converts electromagnetic waves to current. The one antenna element 2403 is the part that is made of a conductive material and is fed by the feed part 404, and may also be referred to as the driven element. The impedance of the circuit electrically connected to the antenna 240 and the impedance of the antenna 240 can be matched by desirably setting the length of the antenna element 2403.

Figure 13:
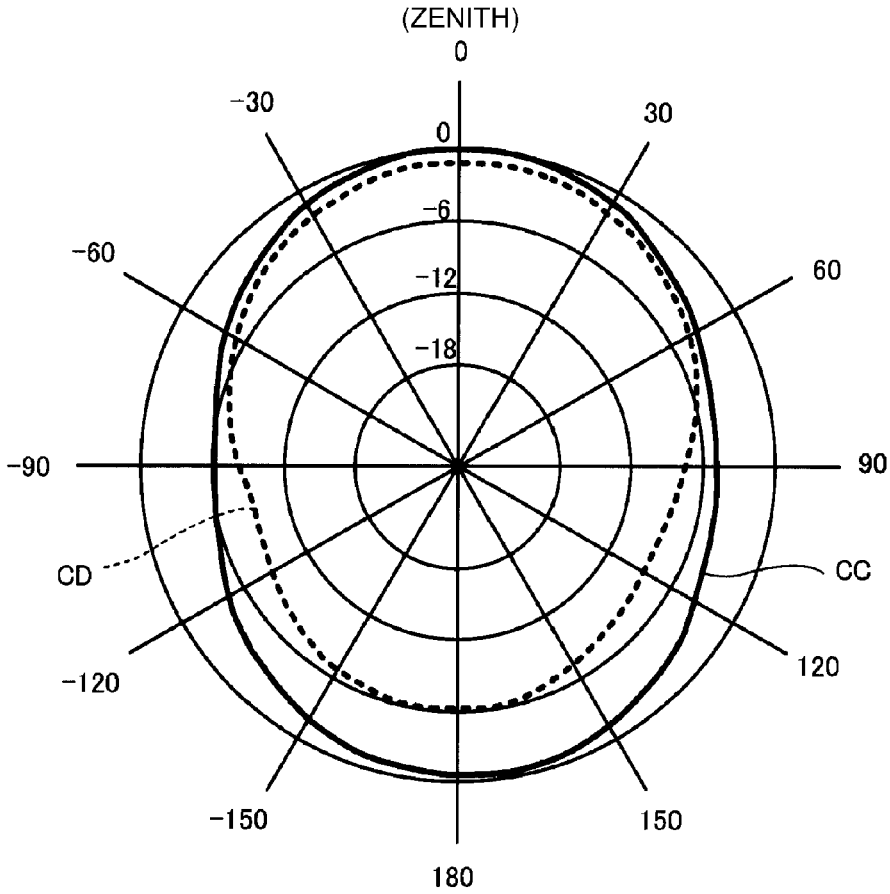
FIG. 13 is a graph showing the results of tests checking the advantage of the reception performance of the antenna in the electronic timepiece according to the first variation.

FIG. 13 is a graph showing the results of tests confirming the benefit of the reception performance of the antenna in the electronic timepiece according to this variation of the invention. In FIG. 13 solid curve CC denotes the directivity of the antenna 240 in the electronic timepiece according to this variation of the invention. Dotted curve CD denotes the directivity of the antenna 240 in an electronic timepiece used for comparison.

Figure 14:
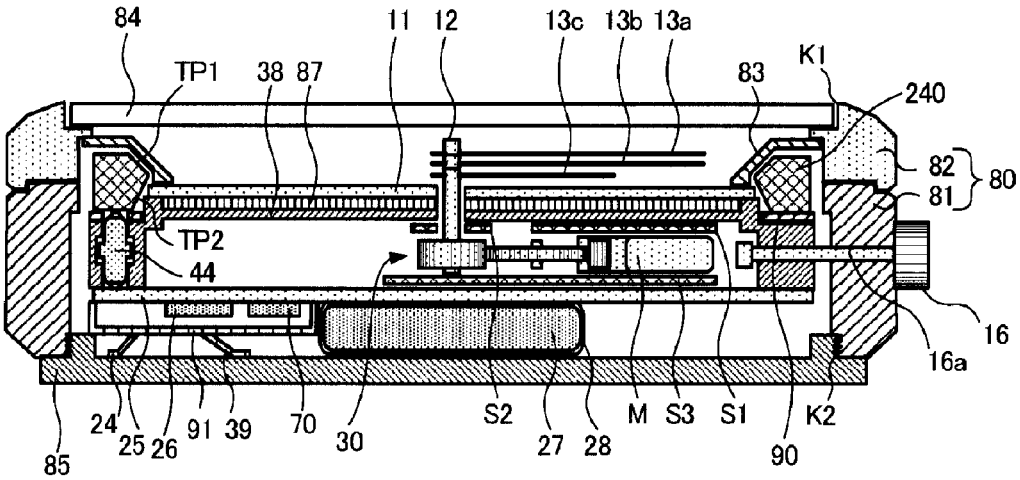
FIG. 14 is a section view of an electronic timepiece used for comparison.

In the electronic timepiece shown in FIG. 14 and used for comparison, the bezel 82 is fit to the outside of the body 81 of the case 80, that is, the reverse of the first embodiment and variation thereof described above. Other aspects of the comparison are the same as in this first variation.

In FIG. 13 the gain of the antenna 240 in the first variation and the comparison is normalized so that the peak gain of the antenna 240 according to the variation denoted by curve CC is 0 dB. The gain of the antenna 240 according to the first variation in the direction of the zenith is 1.1 dB and better than the comparison antenna 240, and average gain in all directions is good at 2.8 dB. The acceptance angle of the antenna 240 in the first variation is greater, and is practical for use in a wristwatch that could be oriented in many different directions when the user is walking, for example. This is because, as in the embodiment described above, the bezel 82 is fit inside the body 81 in the first variation, and the bezel 82 increases the distance between the antenna 240, and more particularly the antenna element, and the conductive body 81.

Variation 2

Figure 15:
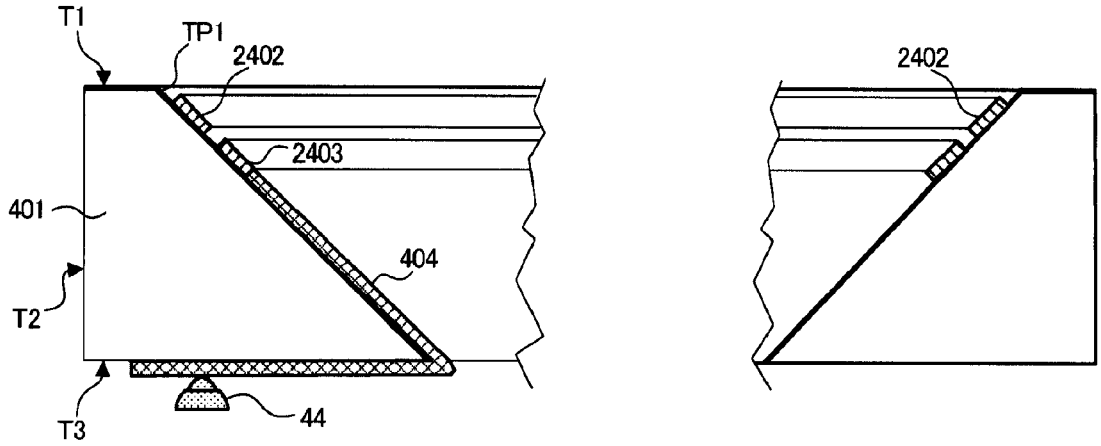
FIG. 15 is a section view of an antenna according to a second variation of the preferred embodiment.

FIG. 15 is a section view of the antenna in variation 2, and is the same as the view in FIG. 5C and FIG. 12C. The base 401 of the antenna in this variation does not have a second slope TP2, and slope TP1 continues to the bottom T3. The top T1 of the base 401 is smaller than in the preferred embodiment above and the first variation. The slope TP1 is therefore larger in this second variation than in the preferred embodiment above and the first variation. The antenna element 2402 (C-shaped loop element) is also formed in addition to the antenna element 2403 (driven element) on the slope TP1. A conductive part of the antenna is not formed on the top T1. Because the top T1 of the base 401 is small in this configuration, the dial 11 is prevented from being hidden by the dial ring 83, and visibility is thus improved.

Variation 3

Figure 16:
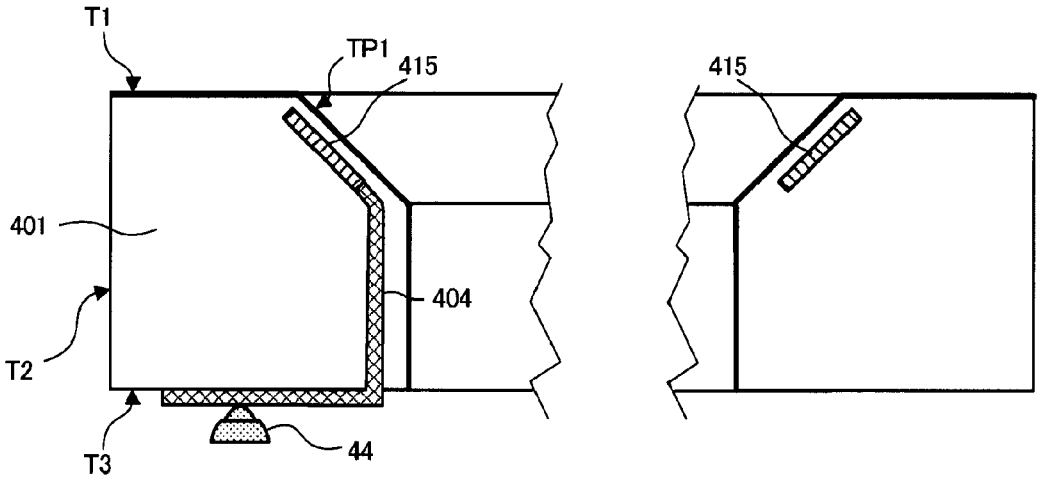
FIG. 16 is a section view of an antenna according to a third variation of the preferred embodiment.

FIG. 16 is a section view of the antenna in variation 3, and is the same as the view in FIG. 5C and FIG. 12C.

In this embodiment of the invention all of the antenna element 415 (C-shaped loop element) and part of the feed part 404 are embedded in the base 401. This configuration can be manufactured by insert molding. Insert molding enables manufacturing the antenna element at a lower cost than using a plating or silver paste printing process. The base 401 in this variation also does not have a second slope TP2, and has a vertical inside face.

Variation 4

Figure 17:
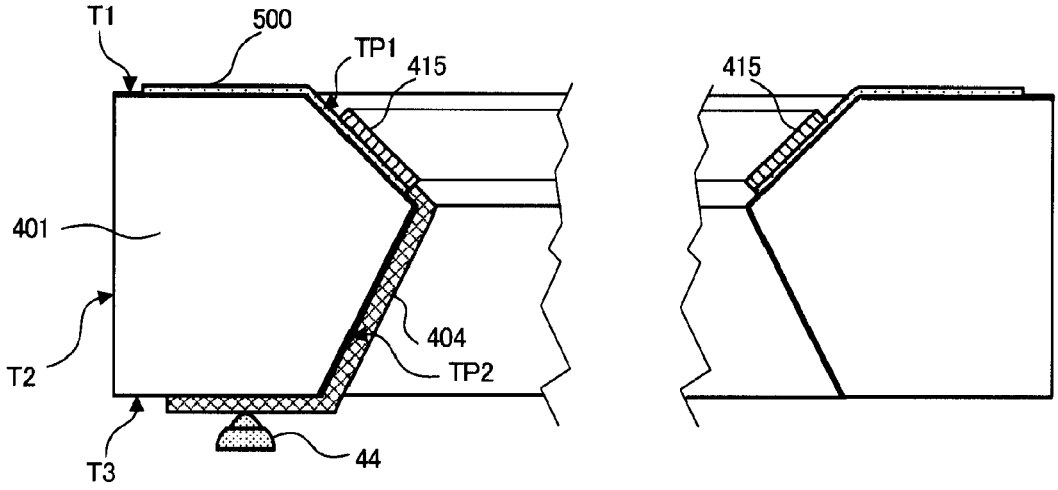
FIG. 17 is a section view of an antenna according to a fourth variation of the preferred embodiment.

FIG. 17 is a section view of the antenna in variation 4, and is the same as the view in FIG. 5C and FIG. 12C. In this embodiment the antenna element 415 (C-shaped loop element) is affixed to the base 401 by flexible tape 500. This configuration can be manufactured, for example, by forming the antenna element 415 on flexible tape 500, and affixing the flexible tape 500 to the base 401. This manufacturing method enables manufacturing the antenna at a lower cost than when the antenna element is formed by a plating or silver paste printing process. The base 401 in this variation also does not have a second slope TP2, and has a vertical inside face.

Variation 5

Figure 18:
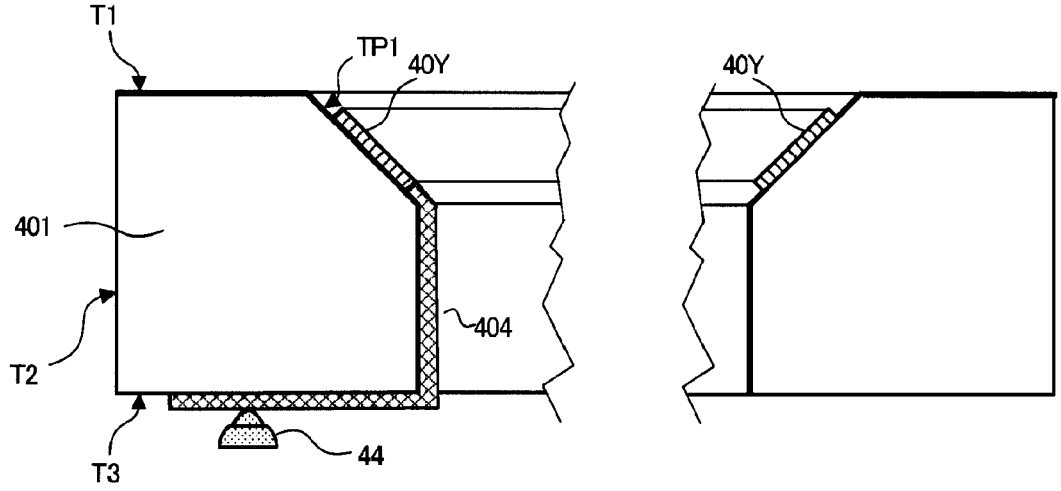
FIG. 18 is a section view of an antenna according to a fifth variation of the preferred embodiment.

FIG. 18 is a section view of the antenna in variation 4, and is the same as the view in FIG. 5C and FIG. 12C. The base 401 in this variation also does not have a second slope TP2, and has a vertical inside face.

Variation 6

The antenna is round in the foregoing embodiments, but could be square or other annular shape. A square annular antenna is desirable for an angular wristwatch having a digital information display unit disposed inside the antenna, for example.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2012-209025, filed Sep. 24, 2012 is expressly incorporated by reference herein.

What is claimed is:

1. An electronic timepiece with internal antenna, comprising:

a case of which at least part is made from a conductive material;

an annular antenna housed in the case;

a feed part that feeds the antenna housed in the case; and a time display unit disposed inside the antenna in plan view;

wherein the antenna has an annular dielectric base, and an antenna element that is made from a conductive material and is fed by the feed part;

the base has a sloped surface that slopes toward the time display unit and decreases in height to the time display unit with proximity to the inside; and the antenna element is disposed to the sloped surface of the base.

2. The electronic timepiece described in claim 1, wherein:

the base has a top that is parallel to the time display unit; and the sloped surface is contiguous to the top.

3. The electronic timepiece described in claim 1, further comprising:

a dial ring that is attached to the case, disposed outside the time display unit, made from a non-conductive material that covers the antenna, and has a sloped part parallel to the sloped surface of the base of the antenna.

4. The electronic time piece described in claim 1, further comprising:

a back cover made from a conductive material;

wherein the case has a cylindrical body made of a conductive material;

the back cover is electrically connected to the body of the case, and electrically connected to the ground of the antenna element of the antenna; and the back cover and case body function as a ground plane.

5. The electronic timepiece described in claim 1, wherein:

the case has a cylindrical body made of a conductive material, and a bezel made of a non-conductive material to which a crystal that protects the time display unit is attached; and the bezel is fit to the inside of the case body.

6. The electronic timepiece described in claim 5, wherein:

the antenna element of the antenna is disposed to a position at a greater height from the time display unit than the body of the case.

* * * * *